US005205668A

United States Patent [19]

Adams

[11] Patent Number: 5,205,668

[45] Date of Patent: Apr. 27, 1993

[54] MANHOLE ADAPTER

[75] Inventor: Charles Adams, Melville, La.

[73] Assignee: AT&T Bell Laboratories, Murray Hill, N.J.

[21] Appl. No.: 677,719

[22] Filed: Mar. 29, 1991

[51] Int. Cl.[5] ..... E02D 29/14

[52] U.S. Cl. ..... 404/26; 52/20

[58] Field of Search ..... 404/25, 26; 52/20–21

[56] References Cited

U.S. PATENT DOCUMENTS

| | | | |
|---|---|---|---|
| 689,224 | 12/1901 | Pillsbury . | |
| 814,013 | 3/1906 | Baumann . | |
| 1,639,495 | 8/1927 | Frame . | |
| 1,841,985 | 1/1932 | Siegel . | |
| 1,959,171 | 5/1934 | Mayer . | |
| 2,431,082 | 2/1945 | Sayles . | |
| 2,593,918 | 4/1952 | Redman | 404/26 |
| 3,773,428 | 11/1973 | Bowman | 404/26 |
| 4,149,816 | 4/1979 | Piso | 404/26 |
| 4,188,151 | 2/1980 | Hall | 404/26 |
| 4,225,266 | 9/1980 | Fier . | |
| 4,273,467 | 6/1981 | Cronk . | |
| 4,281,944 | 8/1981 | Bowman . | |
| 4,466,219 | 8/1984 | Campolito . | |
| 4,673,310 | 6/1987 | LeBaron . | |
| 4,867,601 | 9/1989 | Bowman . | |
| 4,925,337 | 5/1990 | Sress et al. | 404/26 |
| 4,976,568 | 12/1990 | Hess | 404/26 |
| 5,044,818 | 9/1991 | Pritchard | 404/26 |

*Primary Examiner*—Ramon S. Britts
*Assistant Examiner*—Nancy P. Connolly
*Attorney, Agent, or Firm*—Donald E. Hayes, Jr.; Edward W. Somers

[57] ABSTRACT

A cover (56) of an existing manhole is raised in elevation to the elevation of roadway resurfacing, for example, by an adapter (20) which is secured to a head ring (40) of the existing manhole. The adapter is such that when it is secured to the head ring, apertures (77—77) of ledges (75—75) of the adapter may be aligned with threaded apertures (59—59) in lugs of the head ring to which the cover had been secured. Spaced above the ledges and extending peripherally above the head ring is a lip (72) for supporting the cover. At ninety degrees to each of the ledges and projecting from the lip is an ear portion (84) to which the cover may be secured. Additional adapters may be secured to the first adapter which has been secured to the head ring prior to subsequent resurfacing operations.

7 Claims, 4 Drawing Sheets

MANHOLE ADAPTER

TECHNICAL FIELD

This invention relates to a manhole adapter. More particularly, it relates to a manhole which includes an adapter which may be used to elevate a top surface of the manhole to a predetermined level such as, for example, the level of a resurfaced roadway.

BACKGROUND OF THE INVENTION

A manhole comprises apparatus for providing an opening in a surface which opening is large enough to allow craftspersons to descend beneath the surface to obtain access to stored materials or equipment or underground installations. For example, manholes normally are located in roadways or streets to allow access to underground sanitary and storm sewers and utility conduits. These manholes include a metal frame supported by a brick or concrete base structure. The metal frame has an internal annular ledge for supporting a manhole cover which is level with the top of the frame and with a surrounding roadway surface. Because the manhole openings normally are in areas open to pedestrian and vehicular traffic, facilities for securely framing and covering the opening must be provided. Manholes also must be strong enough to withstand all external loadings such as, for example, the loading of vehicles which, invariably, will move across a top surface of the manhole.

In the prior art, a typical procedure has been to frame the opening with an iron casting. The casting includes a flanged surface that in supported on a structure which is disposed beneath the ground level. This supporting structure typically comprises concrete rings or bricks which are dimensioned so that a number of them are sufficient in height to allow a craftsperson to reach an underground installation, for example. The flanged surface of the manhole transmits the weight of the portions of the manhole, such as a cover, together with live surface loads, to the supporting structure.

The cast frame typically incorporates an inwardly projecting circumferential ledge. A cover is supported on the ledge and closes the manhole. The cover typically comprises a removable casting designed to carry the surface loads, and must transmit forces caused by those loads through the frame to the underground supporting structure. Desirably, the cover is heavy, and, preferably, it is bolted to other portions of the manhole in order to deter vandalism.

When resurfacing roadways, a layer of paving material is caused to become disposed over the existing pavement, resulting in the manhole cover being below the top surface of the new pavement and thereby causing a depression in the roadway. When another layer of surfacing material, for example, asphalt, is added to the surface of the roadway, it becomes necessary either to elevate the existing manhole frame to the new level of the roadway, or to install an extension which may be called an adapter between the frame and the cover. A common practice has been to elevate the existing manhole frame by removing the existing pavement around the manhole and increasing the height of support material beneath the manhole frame and then resupporting the frame on the top of the new support material. The level of the frame is adjusted by filling the space between the frame flange and the supporting structure with layers of bricks and mortar. The raised frame is then repositioned and the roadway area abutting the manhole is replaced.

This is a manual, time consuming procedure. Furthermore, should the relationship between the surface of the roadway and the frame be altered, either by settling of the roadway or by the addition of another surface layer, the structure must be dismantled and the brick and mortar courses be reformed. All adjustments such as those for height and slope angle must be made by attempting to fill the space under the frame flange with bricks and mortar. It should be clear that it is desirable to be able to adjust the frame position without disturbing the structure below grade.

An alternate method of changing the level of the frame and the cover includes the step of installing a riser ring or adapter at the top of the frame. The riser ring or adapter is of sufficient height to cause the manhole cover to be elevated to the new level of the roadway required to meet the new road surface. This method appears easy to perform but there are problems. First, with presently used adapters, severe loadings tend to move the adapter and cause the cover to rock because of uneven seating of the adapter with the frame. Thus, it can be difficult to line up the frame top exactly with the finished grade and to maintain alignment of parts of the manhole. Also, the installation of the above-described adapter for raising the elevation of the manhole cover is somewhat complicated and may require special tools.

There have been suggestions that an adjustable frame be used. In such a frame, portions may be raised by turning threaded portions. In this way, portions of the manhole can be raised, lowered or tilted in a variety of positions without riser rings or adapters. Examples of these schemes are indicated in U.S. Pat. Nos. 1,076,386, 2,930,295, 3,263,579, and 3,773,428. These kinds of arrangements feature the use of screw threads in which adjustments are performed from a top portion of the manhole.

The methods described above have not become very popular. There are a number of difficulties associated with them. For example, the adjusting screws often are concealed by an enlarged manhole cover. Cities and municipalities prefer the obvious economy of a standard, interchangeable cover. Secondly, manhole frames often include hollow sections for housing the screw mechanism. Inasmuch as these must be provided in the casting by cores, the cost is increased. Furthermore, locking devices are necessary because all the adjustments for these screw thread mechanisms are made from the top of the frame, that is adjustments are made from the surface of the roadway. The locking devices may be difficult to remove when further adjustments are required. This is because of the small size and the limited space available in typical designs. Because the screw mechanisms are positioned adjacent the surface of the roadway, plugging of the screw mechanism and abrasion by roadway materials may occur. Grease fittings have been used to avoid the abrasion and corrosion but that increases the expense of the assembly and, of course, introduces relatively small parts that can be lost in installation or omitted during the installation.

In another manhole, an adjustable manhole cover support comprises an outer ring having a circular internal opening. A plurality of threaded members are disposed about the interior of the circular opening. An insert is dimensioned to fit within the outer ring to a depth controlled by the abutment of the insert against threaded members and studs to engage and to extend through the threaded members to abut an undersurface of the insert to provide control of the depth of the insert into the outer ring and the angulation of the outer ring. The arrangement includes recesses in the external periphery of the outer ring and corresponding projections on the insert. Threaded inserts are positioned within each projection. Bolts desirably are provided in recesses below the insert so that the studs and their locking mechanisms do not interfere with access into the manhole.

This last described arrangement uses a pair of split rings and clamps which are positioned on top of an existing manhole metal frame so as to increase the effective elevation of the manhole cover and particularly the internal annular ledge which supports the manhole cover. Combinations of split rings and clamps provide a variety of height adjustments with the arrangement of the split rings forming a desirable annular configuration for receiving and holding the manhole cover at the desired increased height. The multiple rings are adjustable secured to the existing manhole metal frame and the roadway. Although the procedure can be performed in a relatively short time at low cost and addresses the problems heretofore associated with raising of the metal frames and the manhole cover supports thereby, the arrangement is somewhat complicated.

What is needed and what seemingly is not provided in the prior art is a manhole system which includes an adapter that is simplistic in its configuration and easy to install. Further, the sought after system should be such that multiple adapters may be used to elevate a manhole cover successively to each of a plurality of resurface elevations.

SUMMARY OF THE INVENTION

The foregoing problems of the prior art have been solved by the manhole of this invention. A manhole of this invention comprises an enclosure having an opening at an upper end thereof and a head ring which is disposed about the opening of the enclosure and supported by an upper portion of the enclosure. The head ring has diametrically opposed lugs which project radially toward a center of the opening and which include threaded apertures therein. The head ring also includes an upper edge surface. An adapter includes an annular post portion which is supported in engagement with the upper edge surface of the head ring and a stem portion which depends downwardly along and in engagement with an inwardly facing surface of the head ring. The stem portion includes a lip having opposed radially projecting ear portions, each ear portion having a threaded opening therein. Further, the adapter includes diametrically opposed depending portions which depend from the stem portion and which include radially projecting ledges each having an aperture therein. Each aperture in each ledge is aligned with one of the apertures in the head ring with the ledge being in engagement with an upwardly facing surface of a base of the head ring. A cover is disposed in engagement with an upper surface of the stem portion of the adapter.

Facilities extend through the apertures in the ledges of the adapter, into said threaded aperatures in said head ring to secure said adapter to said head ring. Facilities extend through the openings in the cover into the threaded apertures of the adapter to secure said cover to said adapter.

In the manhole, an upper elevation of a top surface of each the lug of said adapter is higher than that of a top surface of each of the ledges.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
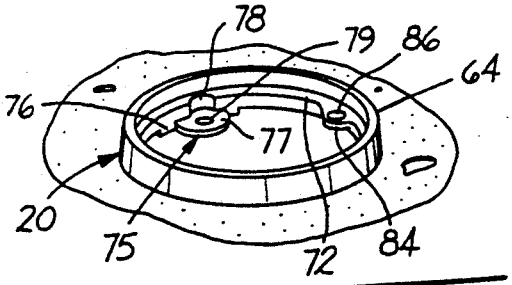
FIG. 1 is a perspective view of an adapter of this invention which may be used to raise the elevation of the cover.
Figure 2:
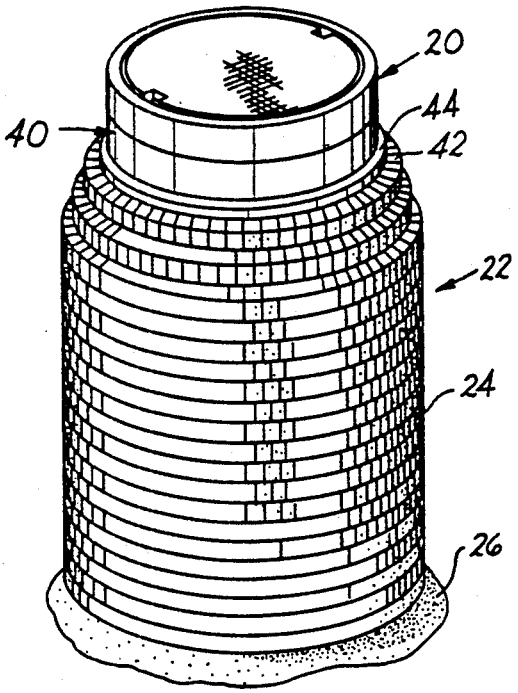
FIG. 2 is a perspective view of a manhole which includes an adapter.

Referring now to FIG. 1, there is shown a perspective view of an adapter which is designated generally by the numeral 20. The adapter 20 is used to raise the elevation of a top surface of a manhole which is designated generally by the numeral 22 and which is depicted in FIG. 2. The manhole 22 may be constructed from a plurality of annular brick or concrete rings 24—24 which are supported on a foundation 26 or may comprise a monolithic cast structure (not shown).

Should the manhole 22 be comprised of a plurality of sections, ones of the sections are tapered or substantially frusto-conical in form to provide for a reduction in diameter of the manhole from a location between a bottom portion of the manhole and its top to its top. Upper portions of the manhole 22 may be constructed of brick or of concrete. Of course, the manhole 22 may comprise a cubical vault having a top slab and a collar riser section which extends therefrom.

Figure 3:
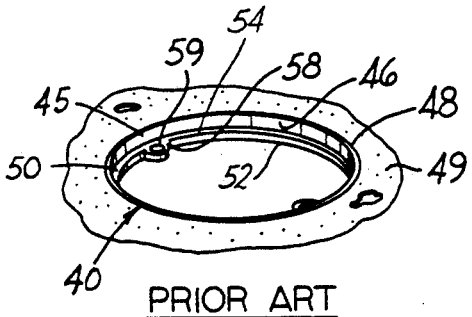
PRIOR ART FIG. 3
FIG. 3 is a perspective view of a head ring of an existing manhole.
Figure 5:
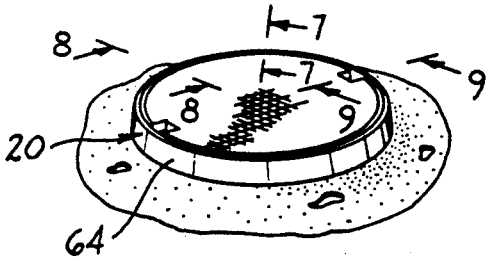
FIG. 5 is a perspective view of the adapter of FIG. 1 with a cover in position prior to resurfacing of the roadway.
Figure 4:
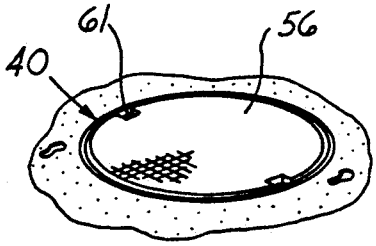
PRIOR ART FIG. 4
FIG. 4 is a perspective view of a cover in position on a manhole opening to a roadway.
Figure 6:
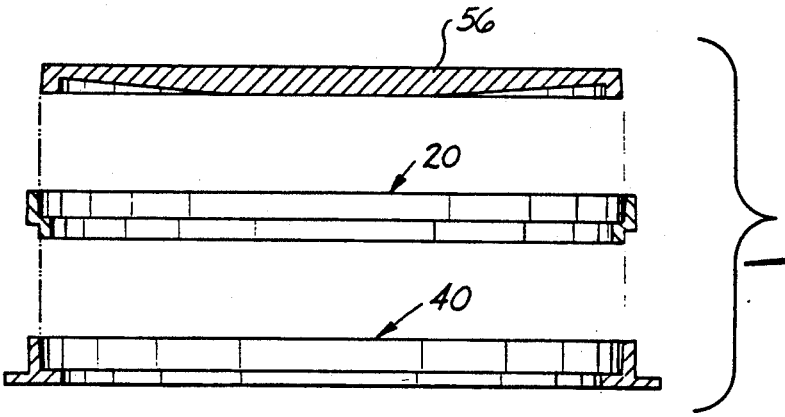
FIG. 6 is an exploded elevational view of the assembly of an adapter of this invention with a head ring of an existing manhole.

As can be seen in FIGS. 2, 3 and 4, an upper portion of the manhole 22 includes a head ring 40 which exists prior to any resurfacing and which is supported by a brick or concrete substructure 42. The head ring 40 includes a footing 44 (see FIG. 2) connected to a vertically extending leg 46 having an inwardly facing surface 45 (see FIG. 3). An upper edge surface 48 of the head ring 40 is at approximately the same elevation as the portion of a roadway 49 to which the manhole opens. The head ring 40 also includes a flange 50 which is cantilevered out from the leg 46 and which has an exposed vertical edge surface 52. As is seen in FIG. 3, the flange 50 includes an upwardly oriented support surface 54.

The head ring 40 includes provisions for securing a cover 56 (see FIG. 4) to the frame. In order to accomplish this, the flange 50 of the manhole head ring 40 is provided with two diametrically opposed lugs 58—58 (see FIG. 3) each of which includes a threaded aperture 59 therein. The cover 56 generally is disc-shaped and includes two diametrically opposed holes 61—61. The diameter of the disc-shaped cover 56 is such that it is capable of being received within the opening defined by the leg 46 of the head ring 40 and supported on the support surface 54 of the flange 50. Bolts may be turned through the holes 61—61 of the cover and into the threaded apertures 59—59 of the lugs of the head ring 40 in order to secure the cover 56 to the head ring.

As the surface of the roadway becomes worn or for other reasons, it may become desirable to renew the surface by the addition of a layer of material such as asphalt or concrete. The grade of the roadway is elevated a distance equal to the thickness of the repairing material.

Figure 8:
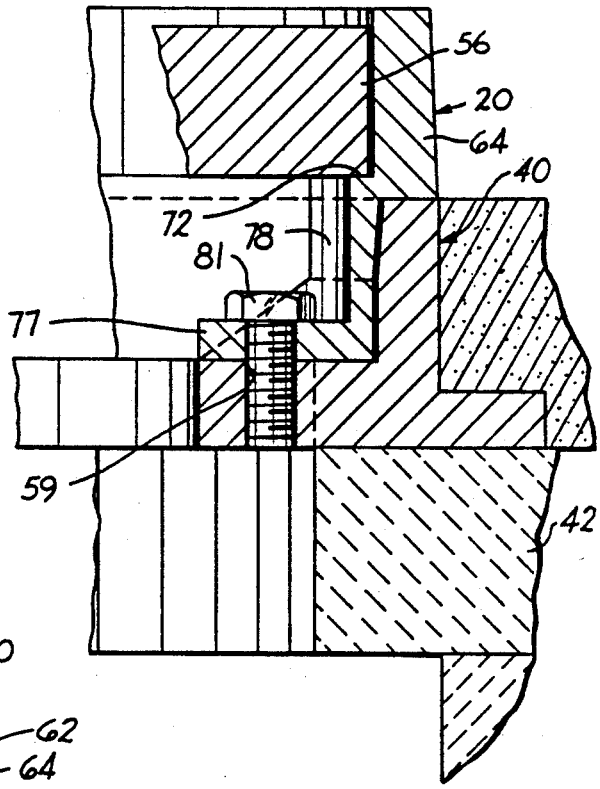
FIG. 8 is a sectional view taken along lines 8—8 of FIG. 5 and showing portions of the adapter which are used to secure the adapter to a head ring of an existing manhole.
Figure 9:
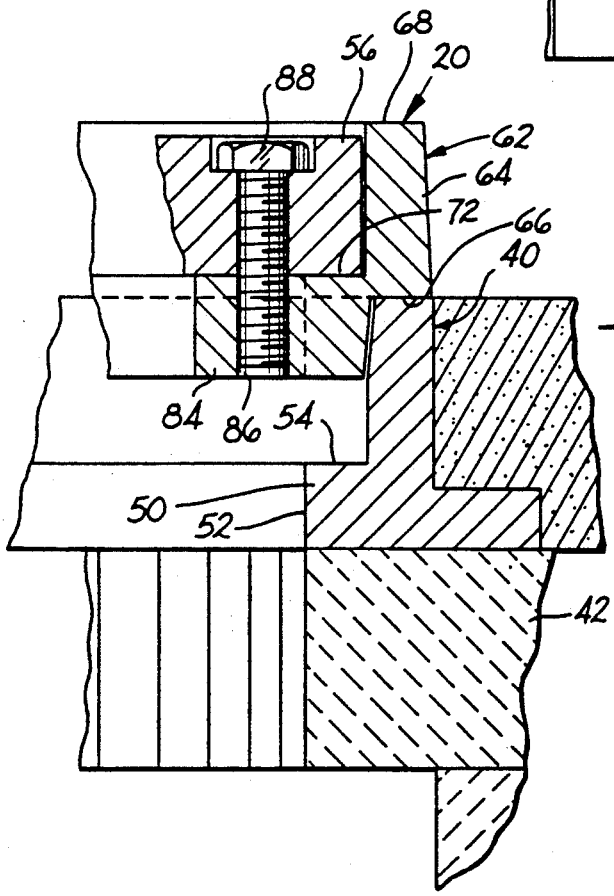
FIG. 9 is a sectional of view taken along lines 9—9 of FIG. 5 and showing portions of the adapter which are used to secure a cover to the adapter.

It becomes necessary to cause the elevation of the outer surface of the cover 56 of the manhole to be raised to be substantially at the same elevation as that of adjacent portions of the new roadway. In order to accomplish this, the manhole 22 is provided with the adapter 20 (see FIGS. 1 and 5-7). A top surface of the cover 56 in FIG. 7 as well as in FIGS. 8 and 9 is shown slightly below the upper surface of the adapter for purposes of clarity.

Figure 7:
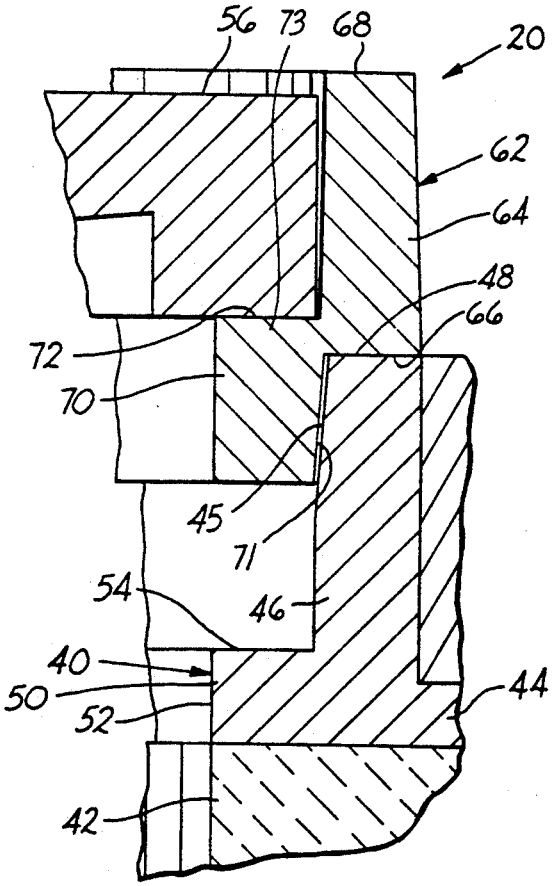
FIG. 7 is a sectional view taken along lines 7—7 of FIG. 5 and showing an adapter of this invention with a head ring of an existing manhole.

As can be seen in FIG. 7, the adapter 20 includes an annular main portion 62. The main portion 62 includes a post portion 64 having an annular bottom surface 66 and an annular top surface 68. The main portion 62 is adapted to be supported by engagement of the annular bottom surface 66 with the upper edge surface 48 of the existing head ring 40. The adapter 60 is stocked in several sizes which may vary in diameter and in the height of the post portion to accommodate different size covers and to be suitable for accommodating different repair thickness.

The adapter 20 also includes a stem portion 70 which depends vertically from the post portion. The stem portion 70 includes an outwardly facing surface 71 which is adapted to engage the inwardly facing vertical surface 45 of the head ring 40. The engagement of the annular bottom surface 66 of the post portion with the upper edge surface 48 of the head ring 40 and the engagement of the outwardly facing surface 71 of the stem portion 70 with the inwardly facing surface 45 of the head ring stabilizes the adapter when the cover 56 is supported on an upper annular lip 72 of the stem portion. Of course, the height of the post portion 64 from the upper annular lip 72 to the annular top surface 68 is such that when the cover 56 is supported on the lip 72 of the stem, the outer surface of the cover is substantially at the same elevation as the annular top surface 68 and hence at substantially the same elevation as the upper surface of adjacent portions of the repaved roadway.

The adaptor 20 also includes provisions for securing easily the adapter to an existing head ring 40 of an existing manhole. This is accomplished by providing the adapter 20 with diametrically opposed portions 75—75 (see FIGS. 1 and 8) which extend from depending portions 76—76 of the stem portion 70 of the adapter. Extending inwardly toward the vertical centerline axis of the manhole from each depending portion 75 is a ledge 77. Each ledge include an aperture 79 therethrough. The apertures 79—79 in the ledges 77—77 are arrayed so that the adapter, when supported on the head ring 40, may be turned to align the apertures 79—79 with the threaded apertures in the head ring 40. Portions of the depending portions 75—75 may have an arcuately formed recess 78 therein to facilitate turning of bolts 81—81 which are used to secure the adapter 20 to the head ring 40.

Also, the adapter 20 includes provisions for supporting and securing the cover plate 56 thereto. As is seen in FIGS. 1 and 9, the depending stem portion 70 includes the inwardly projecting lip 72. The lip 72 may be interrupted at the locations of the depending portions 75—75. Also, projecting radially inwardly from the lip 72 of the stem portion are ear portions 84—84 which are diametrically opposed to each other. When the apertures 79—79 in the ledges 77—77 of the adapter are aligned with the threaded apertures 59—59 in the head ring 40, threaded apertures 86—86 in the ear portions 84—84 are oriented 90° to the bolts 81—81 which secure the adapter to the head ring. The cover 56 may be secured to the adapter 20 by bolts 88—88 which are inserted through the openings in the cover and turned into the threaded apertures 86—86.

Figure 10:
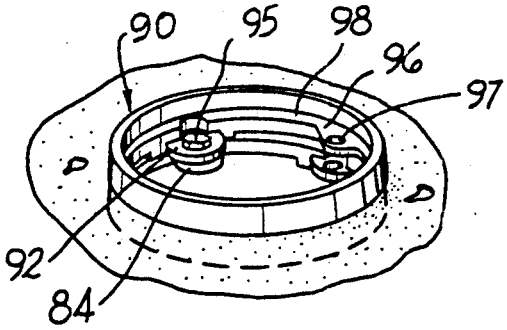
FIG. 10 is a perspective view which depicts a second adapter which has been connected to a first adapter in preparation for a second resurfacing of a surrounding roadway.
Figure 11:
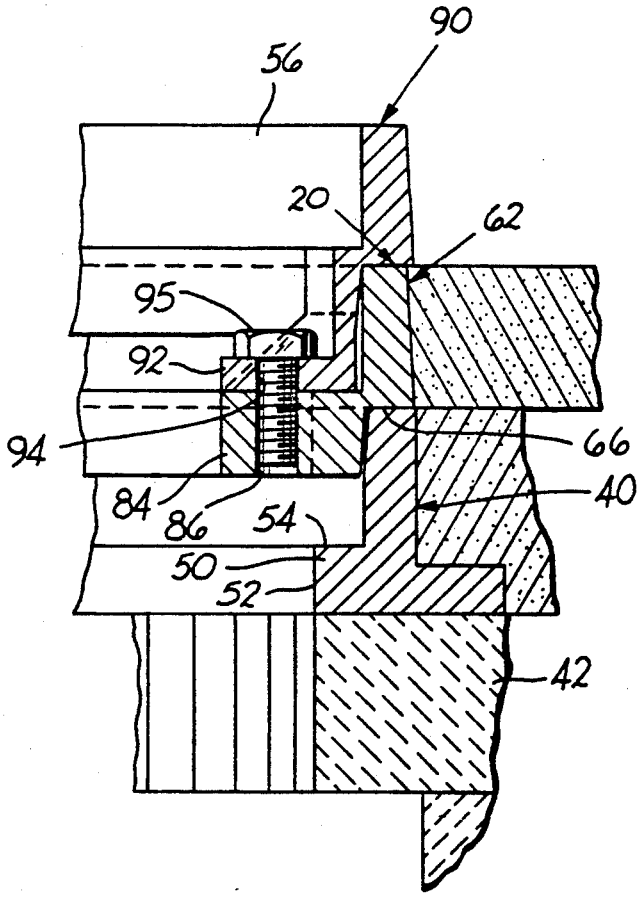
FIG. 11 is a sectional view taken through a portion of the arrangement of FIG. 10.

It should be realized that successive adapters could be used to raise the elevation of the cover 56 still further upon the occurrence of subsequent resurfacing of the roadway. Viewing now FIGS. 10 and 11, it can be seen that another adapter 90 which is identical to the adapter 20 has been assembled to the adapter 20. The adapter 90 has been oriented with respect to the adapter 20 so that ledges 92—92 of the adapter 90—90 are aligned with ear portions 84—84 of the adapter 20. Further, the alignment is such that apertures 94—94 of the ledges 92—92 are aligned with threaded apertures 86—86 of the adapter 20 to allow bolts 95—95 to be inserted through the aperture 94—94 and turned into the apertures 86—86 to secure the adapter 90 to the adapter 20.

With the disclosed orientation, ear portions 96—96, each having a threaded aperture 97 therein and projecting inwardly from a lip 98 of the adapter 90 are each displaced 90° from a ledge 92 and spaced thereabove. A cover 56 having openings 61—61 therein is supported from the lip 98 and secured to the adapter 90 by bolts (not shown) inserted through the openings in the cover and turned into the threaded apertures 97—97 of the ear portions.

Also, it should be realized how relatively uncomplicated is the arrangement of this invention for raising the elevation of the cover of a manhole. Only a few tools are required to install the adapter 20 and the time for installing same is a minimum.

It is to be understood that the above-described arrangements are simply illustrative of the invention. Other arrangements may be devised by those skilled in the art which will embody the principles of the invention and fall within the spirit and scope thereof.

I claim:

1. A manhole, said manhole comprising:

an enclosure having an access opening at an upper portion thereof;

a head ring which is disposed about the access opening of the enclosure and supported by an upper portion of the enclosure, said head ring having an inwardly projecting flange and diametrically opposed lugs which project radially from said flange toward a center of the opening and which include threaded apertures therein, and said head ring further including an upper edge surface;

an adapter which includes an annular post portion which is supported in engagement with said upper edge surface of said head ring and having a stem portion which depends downwardly along and in engagement with an inwardly facing surface of said head ring, said stem portion having a peripherally extending lip which includes an annular surface, wherein said stem portion of said adapter includes opposed radially and inwardly projecting ear portions which project from said lip and which have threaded apertures therein, and said adapter further including diametrically opposed depending portions which depend from said stem portion and which include radially projecting ledges each having an aperture therein, each said aperture in each said ledge being aligned with one of said threaded apertures in said head ring with said each ledge being in engagement with an upwardly facing surface of said flange of said head ring;

a cover which is disposed in engagement with said annular surface of said lip of said stem portion wherein said cover includes two diametrically opposed openings therethrough and wherein said ear portions projecting radially inwardly from said lip of said stem portion have threaded apertures therein and said manhole further includes means extending through said openings in said cover into said threaded apertures of said ear portions of said adapter to secure said cover to said adapter; and means extending through said apertures in said ledges of said adapter into said aligned apertures in said head ring to hold said adapter secured to said head ring.

2. The manhole of claim 1, wherein an upper elevation of a top surface of each said ear portion of said adapter is higher than that of a top surface of each of said ledges.

3. The manhole of claim 1, wherein each of said ear portions projecting from said lip of said adapter is interposed between said two depending portions.

4. The manhole of claim 3, wherein each said ear portion of said lip is displaced 90° from a depending portion of said adapter.

5. The manhole of claim 1, wherein said adapter is a first adapter and a second adapter identical to said first adapter is stacked on said first adapter such that a lower annular surface of a post portion of said second adapter engages an upper annular surface of said first adapter.

6. An adapter which is used to raise the elevation of a manhole cover, said adapter comprising:

an annular post portion which is adapted to be seated in engagement with an upper edge surface of a head ring of an existing manhole, the head ring of the existing manhole having diametrically opposed lugs which project radially inwardly and each of which has a threaded aperture therein; and a stem portion which depends downwardly along and in engagement with an inwardly facing surface of the head ring, said stem portion having a lip for supporting a cover, said stem portion further having diametrically opposed depending portions which depend from said stem portion and which include radially projecting ledges each having an opening therein such that when said adapter is positioned in engagement with the head ring having the diametrically opposed lugs, the ledges are spaced below said lip of said stem portion and said openings in said ledges are alignable with the threaded apertures in said lugs of the head ring to facilitate the securing of said adapter to the head ring, said adapter including two diametrically opposed ear portions being interposed between said depending portions projecting radially inwardly from said lip with an upper elevation of a top surface of each said ear portion of said adapter when in engagement with the head ring being higher than that of a top surface of each of said ledges and wherein each of said radially projecting ear portions which project from said lip has a threaded opening therein to facilitate the securing of a cover thereto.

7. The adapter of claim 6, wherein each said ear portion of said lip is displaced 90° from a depending portion of said adapter.

* * * * *